United States Patent [19]

Woodworth

[11] Patent Number: 4,598,330

[45] Date of Patent: Jul. 1, 1986

[54] HIGH POWER DIRECT CURRENT SWITCHING CIRCUIT

[75] Inventor: George K. Woodworth, Manassas, Va.

[73] Assignee: International Business Machines Corporation, Armonk, N.Y.

[21] Appl. No.: 666,587

[22] Filed: Oct. 31, 1984

[51] Int. Cl.[4] ..... H01H 73/18

[52] U.S. Cl. ..... 361/13; 361/3; 361/8; 307/115; 307/134

[58] Field of Search ..... 361/2, 6, 13, 3, 8, 361/5, 9; 307/115, 134, 135

[56] References Cited

U.S. PATENT DOCUMENTS

| | | | |
|---|---|---|---|
| 3,075,124 | 1/1963 | Bagno . | |
| 3,184,619 | 5/1965 | Zydney | 307/134 |
| 3,330,992 | 7/1967 | Perrins | 361/13 |
| 3,430,063 | 2/1969 | Webb | 361/13 |
| 3,474,293 | 10/1965 | Siwko et al. . | |
| 3,504,233 | 3/1970 | Hurtle . | |
| 3,555,353 | 1/1971 | Casson . | |
| 3,558,910 | 1/1971 | Dale et al. | 361/13 X |
| 3,639,808 | 2/1972 | Ritzow . | |
| 3,912,941 | 10/1975 | Passarella . | |
| 4,250,531 | 2/1981 | Ahrens | 361/2 |
| 4,251,845 | 2/1981 | Hancock | 361/13 X |
| 4,315,307 | 2/1982 | Jacquart | 363/134 |
| 4,420,784 | 12/1983 | Chen et al. | 361/13 X |
| 4,438,472 | 3/1984 | Woodworth | 361/2 X |

*Primary Examiner*—A. D. Pellinen
*Assistant Examiner*—A. Jonathan Wysocki
*Attorney, Agent, or Firm*—John E. Hoel

[57] ABSTRACT

A DC power switching circuit connecting a load to a DC power source while suppressing arcing across a relay in the network. A normally open relay has its energizing coil connected to the control input of the circuit, the opposite end of the coil being connected to the gate of a silicon controlled rectifier. The SCR has its principal current conducting path connected between the load and the DC power source, for conducting current between the load and the power source during a first delay interval, thereby reducing the potential difference between the contacts of the relay so as to prevent its arcing during the closure of the contacts. An FET device has its principal current conducting path connected between the load and the DC power source and has its gate connected to a timer. The timer has a control input connected to the control input of the circuit so that it turns on the FET for a duration of a second delay interval in response to an off signal at the control input for the circuit so that the relay contacts are shunted while they are opening from a closed state, thereby preventing arcing across the contacts. In this manner, the relay is protected from arcing both on opening and closing of its contacts.

2 Claims, 5 Drawing Figures

HIGH POWER DIRECT CURRENT SWITCHING CIRCUIT

FIELD OF THE INVENTION

The invention disclosed broadly relates to arc suppression circuits and more particularly relates to an active arc suppression circuit for switching direct currents.

BACKGROUND OF THE INVENTION

There is a significant need for controlling high voltage direct current with a physically small switching device, such as a relay. The problem involved in satisfying this need, however, is that as the contacts of a relay are opened or closed, the electrical discharge created by the interruption of the electrical current due to contact bounce or the opening of the contacts causes heating which burns and erodes the electrodes, leading to welding and destruction of the relay contacts. A number of attempts have been made in the prior art to solve this or similar problems. For example, U.S. Pat. No. 4,250,531 to Ahrens discloses a switch-arc preventing circuit which employs a varistor in shunt connection across the power electrodes of the switching transistor to limit inductive spikes. A defect of this approach is that the relay is not actually controlling the power but is instead providing a control signal to power switching transistors. Power switching transistors cannot handle the high power switching requirements which currently exist. Another approach attempting to solve the arc suppression problem is shown in U.S. Pat. No. 3,912,941 to Passarella, which discloses an isolation circuit for arc reduction in a DC circuit. This circuit employs a transistor in which the collector and emitter are connected in series with the power supply and the load while the base is connected through a resistive gating circuit to the switch. Once again, the transistor switch switching contacts isolated from the load are not arc suppressed. And furthermore, the load current is limited by the transistor switch. Still a further attempt to solve the arcing problem is described in U.S. Pat. No. 3,184,619 to Zydney, which discloses a contact noise suppressor. When the contacts open, the negative potential provided by the source is disconnected from the load circuit. Contact bounce, however, is not arc suppression and the patented device serves only to reduce load sensitivity to erratic closure or bounce of the contacts and does not serve to suppress the arcing associated with switching large direct current power. The disclosed circuit is basically a pulse stretcher which is configured for normally closed contacts and does not effectively suppress arcs. Furthermore, the timing for the circuit is controlled by a resistor and is relatively slow and cannot provide for a rapid recovery to defeat contact bounce effects. Another attempt of solving the problem of arc suppression has been described in U.S. Pat. No. 3,075,124 to Bagno, which discloses a contact protection circuit which is connected in series between the power supply and the protected contacts. The protective circuit must pass all power through the active device and therefore arc suppression upon opening of the contacts would be almost nonexistent. This is because charges are stored in the active devices and thus they cannot reduce the energy at the contacts unless there is a very low power level.

U.S. Pat. No. 3,504,233 discloses a pair of oppositely connected SCRs 20 and 21, for shunting an AC circuit breaker 10. The gates of the SCRs are directly connected to the contact members 18 of the circuit breaker 10. During arcing of the contact member 13, the SCRs will conduct (depending upon the specific half cycle of the AC current). This circuit has the limitation that it must have alternating current in order to operate, since the only way to make the SCRs 20 and 21 turn off after they have shunted the current around the circuit breaker 10, is for the power supply to go through the zero cross-over which only occurs in AC power supplies, not DC power supplies. The circuit disclosed in the patent would not work for DC power supplies. Another patent making a similar disclosure is U.S. Pat. No. 3,639,808, which also suffers from the same limitation.

U.S. Pat. No. 3,555,353 discloses a TRIAC D having its gate electrode 22 directly connected to a relay coil RW controlling the AC relay switch RK, such that the TRIAC is turned on to suppress arcs when the switch is closed. There is no protection for the switch on the opening thereof because the TRIAC is off first before the contacts open. Still further, the circuit would not work for DC power supplies, since once again, the TRIAC would not turn off without a zero transition for the power supply which is only available for AC power supplies.

U.S. Pat. No. 3,474,293 discloses another TRIAC arc suppressing circuit which protects only on the opening of the switch but does not protect on the closing of the switch. Once again, the circuit would not work in a DC environment since the TRIAC must be turned off when the AC power supply goes to zero, a situation which is not present in a DC system.

In summary, the prior art has been unable to provide an adequate solution to the problem of active arc suppression for switching DC current circuits.

OBJECTS OF THE INVENTION

It is therefore an object of the invention to provide an active arc suppression circuit for switching direct current.

It is still another object of the invention to provide an active arc suppression circuit which effectively suppresses arcs during the opening and closing of mechanical contacts switching direct current.

It is still a further object of the invention to provide an improved arc suppression circuit capable of handling larger magnitudes of direct current than has been available in the prior art.

SUMMARY OF THE INVENTION

These and other objects, features and advantages of the invention are accomplished by the direct current switching circuit disclosed herein. A DC power switching circuit is disclosed connecting a load to a DC power source while suppressing arcing across a relay in the network. A normally open relay has its energizing coil connected to the control input of the circuit, the opposite end of the coil being connected to the gate of a silicon controlled rectifier. The SCR has its principal current conducting path connected between the load and the DC power source, for conducting current between the load and the power source during a first delay interval, thereby reducing the potential difference between the contacts of the relay so as to prevent its arcing during the closure of the contacts. An FET device has its principal current conducting path connected between the load and the DC power source and has its gate connected to a timer. The timer has a control input connected to the control input of the circuit so that it turns on the FET for a duration of a second delay interval in response to an off signal at the control input for the circuit so that the relay contacts are shunted while they are opening from a closed state, thereby preventing arcing across the contacts. In this manner, the relay is protected from arcing both on opening and closing of its contacts.

DESCRIPTION OF THE FIGURES

These and other objects, features and advantages of the invention will be more fully appreciated with reference to the accompanying figures.

DISCUSSION OF THE PREFERRED EMBODIMENT

Figure 1:
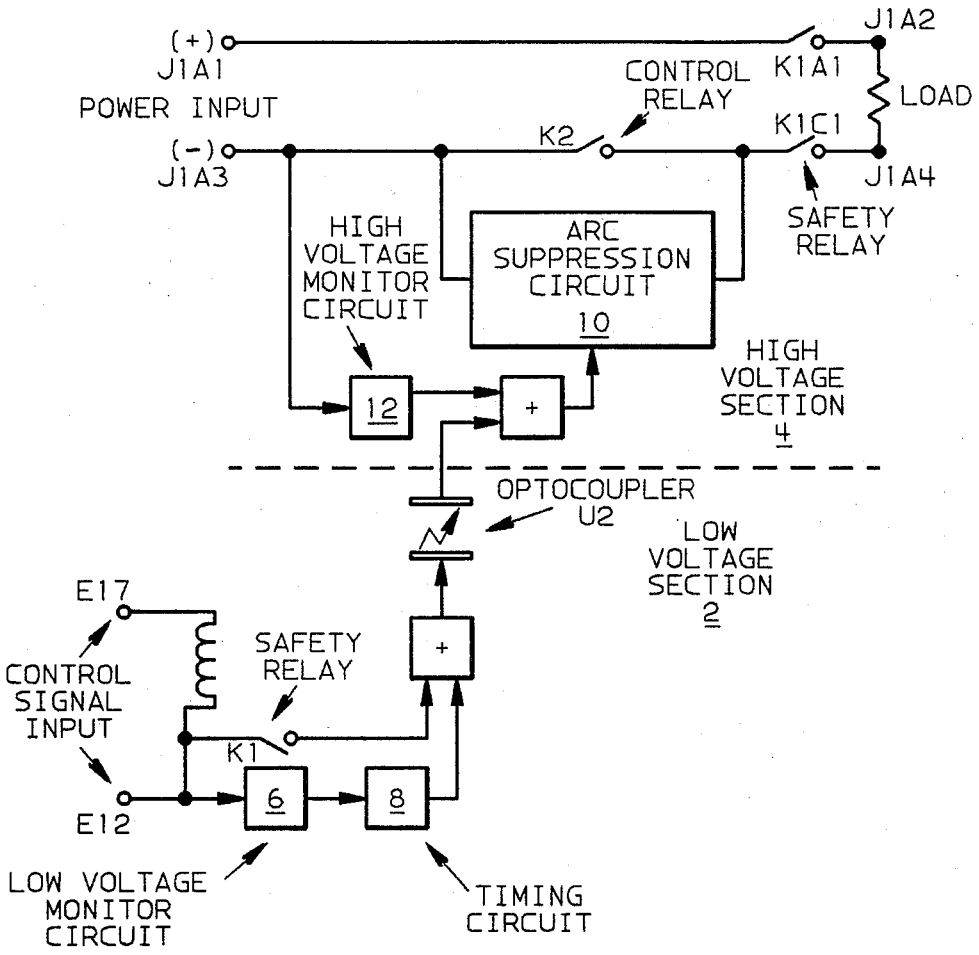
FIG. 1 is a functional block diagram of the direct current switching circuit.

FIG. 1 is a functional block diagram of the direct current switching circuit. The objective of the circuit is to switch large quantities of DC current without burning out the relay and while insuring safety to the operator. The functional block diagram of FIG. 1 is divided into two major sections; the low voltage section 2 is a low voltage control circuit which accepts a low voltage input signal between the terminals E12 and E17 and provides an enabling signal to the optocoupler U2. The other major section of the circuit is the high voltage power switching section 4, which receives the signal from the optocoupler U2 and performs the switching function for the high voltage DC current applied at the terminals J1-A1 and J1-A3.

Figure 2A:
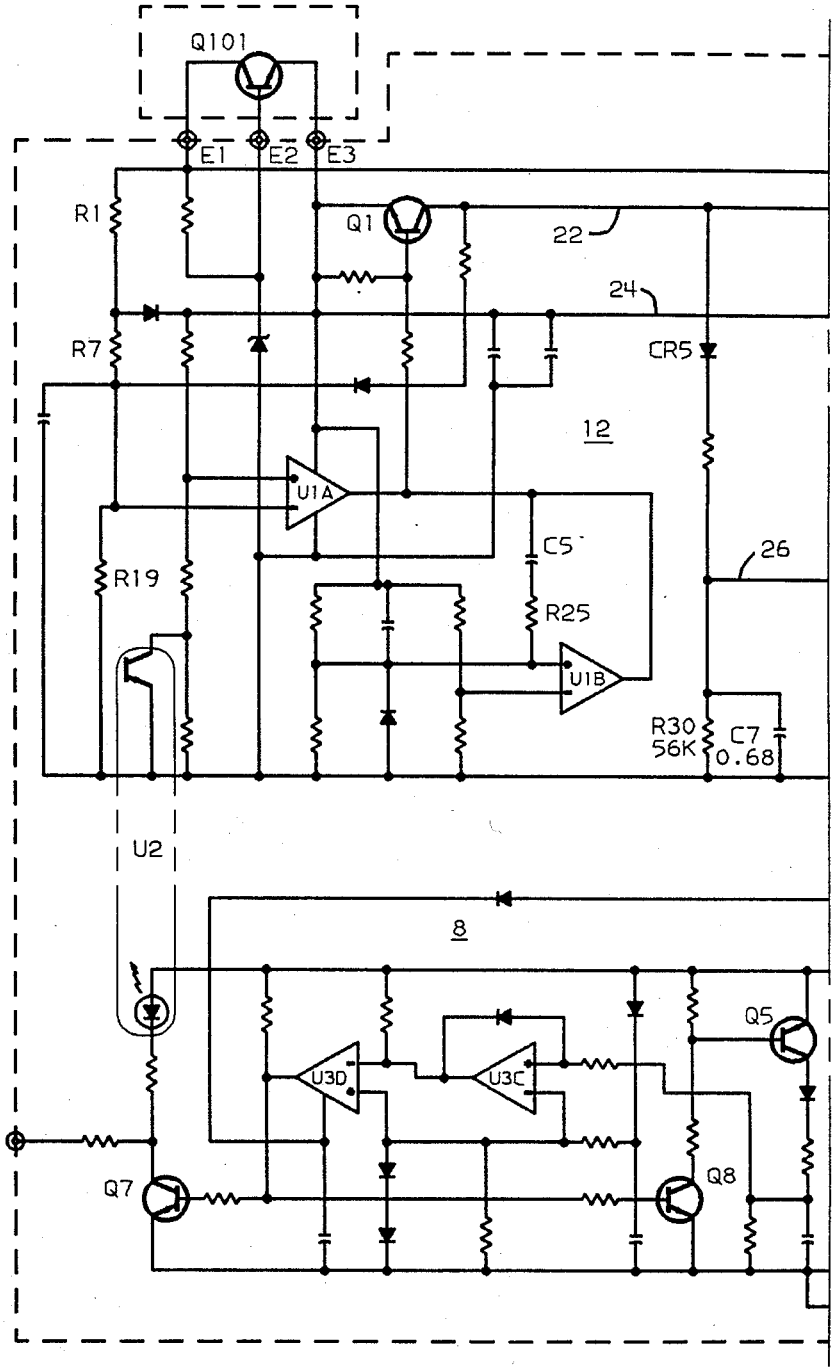
FIG. 2 is a more detailed schematic diagram of the circuit of FIG. 1, showing the low voltage section 2 and the high voltage section 4.
Figure 2B:
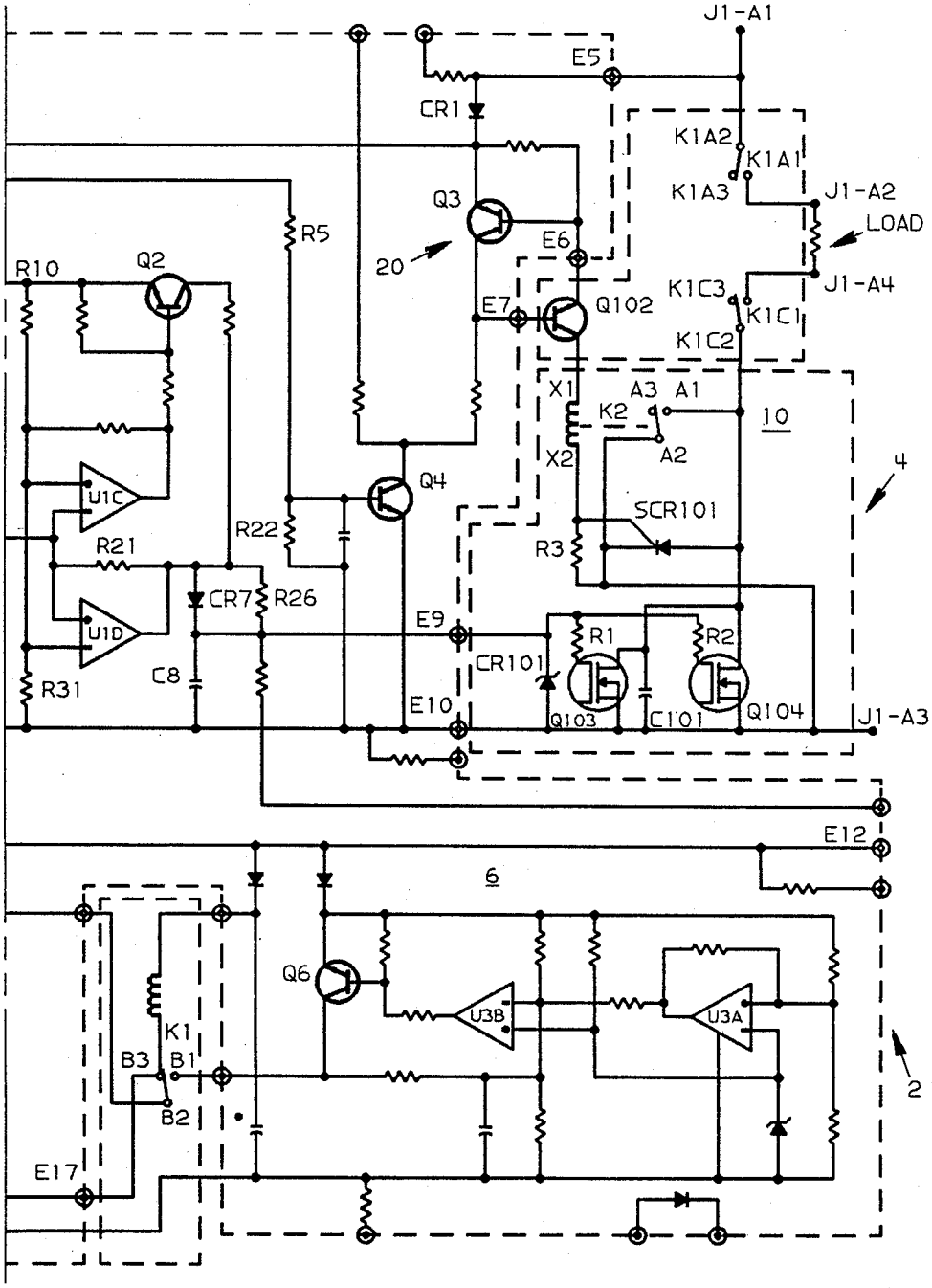

FIG. 2 is a more detailed schematic diagram of the direct current switching circuit. The circuit of FIG. 2 is designed to provide for the switching of high power direct current. High power direct current carries a high voltage, for example a typical application is a 155 volt, 20 ampere system which can experience surges of up to 300 amperes. It is the objective of this circuit to switch such high currents with a minimum of power dissipation during the switching operation and during sustained intervals of current conduction. The minimization of power dissipation is necessary in order to reduce the amount of heat generated by the circuit and also for improved efficiency and economy of operation.

The low voltage control section 2 provides the control and operation for the high voltage section 4, by monitoring the input voltage applied at the control inputs E12 and E17 so as to insure a stable turn-on condition. The nominal potential difference between the input low voltage terminals E12 and E17 is, for example, 26 volts. In addition to the basic control and operation of the circuit, the low voltage section 2 provides a short cycling control circuit which provides a delay and override protection feature so as to insure a timely and complete sequencing for the operation of the control circuit both during the turn-on phase and the turn-off phase. This has been found necessary in order to insure that all of the functions provided by the circuit occur in a predictable sequential manner so as to provide a normal operation without disruptive failures.

The low voltage control section 2 is connected to the high voltage switching section 4 by means of the optocoupler U2 which provides both control and electrical isolation between the low voltage section 2 and the high voltage section 4. This provides operator and equipment protection. The high voltage switching section 4 has a voltage level detection circuit 12 and some additional control functions. In addition to monitoring the high voltage input at the terminals J1-A1 and J1-A3, in order to verify that a proper power supply amplitude is being maintained, the high voltage section 4 also verifies that the optocoupler U2 has properly signaled the turn-on condition, and these two monitoring signals are together responsible for the switching on of a high voltage relay K2 in the arc suppression circuit 10.

The high voltage relay K2 and the arc suppression circuit 10 will connect or disconnect the load to the source of direct current power connected at the terminals J1-A1 and J1-A3 and will, at the same time, provide for arc suppression of any arcing which might occur across the contacts K2-A1 and K2-A2 of the relay during the opening or closure of those contacts. This is accomplished by switching the relay K2 at an instant when the voltage across the contacts K2-A1 and K2-A2 is at a very low magnitude. Normally, in direct current operations, there is no crossover or zero point and as a result, it is necessary to artificially generate such a zero point, so as to provide a safe environment in which the relay contacts for the relay K2 may safely interrupt or connect the load across the power source.

As an additional safety feature for the circuit of FIG. 2, a set of safety contacts K1-A1/A2 and K1-C1/C2 have been added between the load terminals J1-A2 and J1-A4 and the balance of the direct current switching circuit. These safety relay contacts are not protected from arcing and are intended to only provide for a disconnection of the load when the direct current switching circuit is turned off. In this manner, no leakage within the solid-state arc suppression circuitry could possibly find the path through the load to the operator during equipment servicing, for example.

In the low voltage control section 2 of FIG. 2, the level detection circuitry 6 insures that a valid turn-on input signal has been applied to the input terminals E12 and E17. In the particular application disclosed, the low voltage input turn-on signal is nominally 26 volts. In order to make sure that the circuit is operating properly, it is necessary to be sure that the input of 26 volts has at least a minimum amplitude of 18 volts, for example, and that it is not bouncing about in amplitude in such a manner as to cause the low voltage section 2 to partially turn on and then lose control. This control is achieved with the comparators U3A and U3B of FIG. 2. The comparators U3A and U3B drive the switching transistor Q6 into conduction so as to provide a control voltage to the balance of the low voltage control section 2. If the input control voltage signal between the terminals E12 and E17 is not of a sufficiently large magnitude or if it does not stay at a proper magnitude for a long enough duration, the low voltage control circuit 2 will not allow a start-up to occur and the switching transistor Q6 will not be turned on. In this application, the requirements are that the control voltage input at terminals E12 and E17 must be above 18 volts and stay at that amplitude for a long enough duration to insure normal operation. After a brief delay of a few milliseconds, Q6 will normally be turned on. Thus, the 26 volt signal is switched through the transistor Q6 to the K1 relay contact B1. The low voltage K1 relay is operated from the 26 volt line and turns on when the voltage to it is of a sufficient amplitude to close the relay (normally less than 18 volts) and when this occurs, the K1 relay switches all three sets of contacts, K1-A1 and A2; K1-B1 and B2; and K1-C1 and C2.

The connection of the contacts B1 and B2 of the low voltage relay K1 is used to verify the closure of the relay. If the relay K1 is not closed, then this will be detected by the closure of the contacts B1 and B2 which will indicate that the contacts A1 and A2 and the contacts C1 and C2 have also not been closed and that there is no path to the balance of the control circuitry. In this circumstance, it is insured that no power will be applied to the output terminals J1-A2 and J1-A4 through the unprotected K1 relay contacts A1 and C1 prior to initiating a valid turn-on operation. After the relay K1 has actually closed, this requiring some eight to 10 milliseconds, the closure of the B1-B2 contacts of the K1 relay supplies a path of 26 volts through to the other portion of the low voltage circuit 2, namely the timing circuit 8. The timing circuit 8 includes two comparators U3C and U3D which provide an additional delay. Once the K1 relay is turned on, there is a timing sequence imposed by the timing circuit 8, prior to energizing the optocoupler U2. Once the relay K1 has closed and if the 26 volt input signal should be lost for any reason, for a period greater than 15 milliseconds, the optocoupler U2 will be turned off and held off for a minimum of one second. This one second delay insures that all of the other electrical components and the electromechanical relays in the low voltage section 2 and in the high voltage section 4 will return to their rest positions and will be able to restart from a predictable point. This insures that if the 26 volt control signal were inadvertently turned on/off, even though it had the correct amplitude, that this circumstance would not trigger a sequence of high voltage intervals applied through the relay K2, thereby causing an excessive dissipation of power.

If a proper voltage is applied to the optocoupler U2 for a sufficiently long period of time to initiate its operation, after having been sequenced through the transistor Q6, the relay K1 and the balance of the timing circuit 8 of the low voltage section 2, the optocoupler will turn on and provide an enabling signal to the high voltage section 4. The optocoupler U2 provides voltage isolation and control to the high voltage section 4.

In the high voltage section 4, the high voltage is applied at pins J1-A3 and J1-A1. The high voltage from pin J1-A1 is passed through node E5 and the diode CR1 so as to insure that proper voltage polarity will be maintained. The high voltage is then applied to the transistor Q101 which connects to the nodes E1, E2 and E3, so as to provide a stable 24 volt source of voltage from the high voltage source. This stable 24 volt source provides the device power to the balance of the control circuitry in the high voltage section 4.

The output of the optocoupler U2 is applied to one input of the comparator U1A and its voltage amplitude is compared to a voltage amplitude derived from the magnitude of the high voltage applied at the terminals J1-A1 and J1-A3. The resistor divider made up of the resistors R1, R7 and R19, apply a reference voltage at the negative input to the comparator U1A, which is proportional to the magnitude of the high voltage applied to the terminals J1-A1 and J1-A3. Thus, if the high voltage applied at the terminals J1-A1 and J1-A3 deviates from a nominal value, then even though the optocoupler U2 provides an enabling signal to the high voltage section 4, the comparator U1A will not be satisfied and therefore will not provide an enabling signal to turn on the relay K2.

It will be recalled that the low voltage section 2 includes a timing circuit 8 which will not allow consecutive turn-on events to occur for a minimum of one second, in order to avoid rapidly cycling on and off the high voltage. However, once an affirmative turn-on cycle has been completed, the comparator U1B in the high voltage section 4 will provide a minimum on-time interval to allow complete operation. This is carried out with the capacitor C5 and R25 which, when once charged up, maintain the enabling signal applied at the outputs of the comparators U1A and U1B to the base of the transistor Q1. Thus, when an affirmative turn-on event has been initiated for even as short an interval as one millisecond, continuous operation for the turn-on cycle will continue for at least a minimum of from 30 to 50 milliseconds so as to guarantee that a complete turn-on sequence will be provided. When the transistor Q1 turns on, it applies the 24 volt enabling signal from the node E3 to the base of the transistor Q4. This, in turn, applies an enabling signal to the gates of the Hexfet transistor Q103/Q104.

The Hexfet transistor Q103/Q104 is shown as two devices which are connected in parallel to provide ample current carrying capabilities. To turn on the Hexfet device, Q103/Q104, the transistor Q2 supplies a voltage to the gate of the two Hexfet transistors. This is done after a brief delay to verify that the voltage at the node E9 is in fact rising, and it is also done to minimize interference from static or noise spikes. When Q2 is switched on and supplies voltage to the gates of the two Hexfet devices Q103 and Q104, the devices Q103 and Q104 go into conduction. The zener diode CR101 provides a voltage regulation function for the enabling voltage applied to the gates of the Hexfet devices. The transistor Ql supplies a voltage to the base of transistor Q4. Transistor Q4 is a relay driver which is turned on by the voltage being fed through the resistor R5 and the resistor divider R22. When Q4 turns on and switches, its collector goes to a low level voltage and reduces the potential at the node E7. This turns on the transistor pair Q3 and Q102. A transistor pair Q3 and Q102 provide a current control operation, allowing approximately 24 milliamperes to flow through the K2 relay coil. The reason for this is when the voltage is applied at the terminals J1-A1 and J1-A3 are between 100 and 200 volts, a current value of approximately 24 milliamperes flowing through the relay coil will have a sufficiently low power dissipation to avoid overheating. Essentially, the transistor pair Q3 and Q102 serve a current limiting function, allowing substantially no more than 24 milliamperes to flow through the relay coil for the relay K2. This quantity of current is sufficient to turn on the relay K2 and yet will not be so excessive as to burn out the coil.

As transistor Q4 turns on the transistor pair Q3 and Q102, coil current is supplied to the relay K2. This event initiates the closure of the contacts K2-A1 and K2-A2. This closure takes approximately five to 10 milliseconds. The current flowing into the coil of the relay K2 also flows into the gate of the SCR device SCR101. The gate of the SCR is supplied with 24 milliamperes of the relay current, thereby turning it on in less than one microsecond.

The net effect of the sequence of operations discussed above for the high voltage section 4 and the low voltage section 2 is as follows. The overall circuit guarantees a sequence of operations. The current through the relay coil for the relay K2 will not turn on the contacts K2-A1 and K2-A2 for a minimum of five to 10 milliseconds because of the inherent mechanical delay. The SCR device SCR101 however, turns on almost instantaneously. The SCR device SCR101 operates to effectively shunt current around the contacts K2-A1 and K2-A3 of the relay K2 and to provide the capability for handling very high in-rush currents to the relay K2. In the instant application, because of the capacitive nature of the load connected to the output terminals J1-A2 and J1-A4, there can be as much as 300 amperes of in-rush current. This short duration current will be handled by the SCR device SCR101. After the period of from five to 10 milliseconds, the K2 relay contacts A1 and A2 are closed. This will then provide a low resistance, low power dissipation path for the current to flow from the high voltage terminal J1-A1, through the load and through the relay K2's contacts A1 and A2 to the other high voltage terminal J1-A3.

The relay K2 is the primary device for handling the high currents. After the two low voltage relay contacts are made at K1-A1/A2 and K1-C1/C2, the full voltage of 155 volts is dropped across the K2 relay's contacts A1 and A2. When the SCR device SCR101 turns on, a current path through the load from the terminal J1-A4 to the terminal J1-A3 is provided. Since this current path shunts the relay K2, the relay contacts K2-A1 and K2-A2 can then be allowed to close without arcing. Once the relay contacts K2-A1 and K2-A2 are closed, both the SCR device SCR101 and the relay K2 are connected in parallel to carry the load current. Now, because the potential drop across the K2 relay contacts K2-Al and K2-A2 is very small because of the low resistance inherent in the relay, the potential across of the relay, and therefore across the SCR device SCR101 is less than one volt in magnitude and the quantity of current passing through the cathode-anode half of the SCR device is essentially zero. However, as long as the relay K2 has its coil energized by current from the transistor Q102, gate current is being supplied to the SCR device SCR101 and therefore the SCR device will remain in conduction.

After the SCR device SCR101 started conduction and after the contacts K2-A1 and K2-A2 of the relay K2 were closed, the circuit is considered to have been switched on. In the short interval of time between the turn-on of the SCR device SCR101 and the closure of the contacts K2-A1 and K2-A2 of the relay K2, the capacitive timing delays driving the comparators UlC and U1D of the high voltage section 4 have provided a turn-on signal to the gates of the Hexfet devices Q103 and Q104. The Hexfet device provides a third path in the sequence. The SCR device SCR101 turns on first, the Hexfet devices Q103 and Q104 turn on second, and the relay K2 has its contacts A1 and A2 turn on third. This provides three parallel paths for the load current, although virtually the entire current will be flowing through the relay contacts K2-A1 and A2 when the circuit is fully on. The reasons for providing three paths is as follows.

During the period when the circuit is fully operational applying power to the load, if the high voltage should be momentarily interrupted, the contacts A1 and A2 of the relay K2 will provide continuous operation for up to five milliseconds before they mechanically separate. As soon as the high voltage turns back on, since the transistor pair Q3 and Q102 are being turned on, gate current is continuously supplied to the SCR device SCR101. Even if the high voltage is interrupted for a longer interval of several milliseconds up to tens of milliseconds, if the optocoupler U2 is turned on, there will be an almost immediate turn-on of the SCR device SCR101. Thus, the relay K2 will not experience any problems on reclosure. Alternately, during a normal process of opening the relay K2, when the optocoupler U2 is turned off by the low voltage section 2, or if the high voltage input at the terminals J1-A1 and J1-A3 falls below approximately 100 volts turning off the comparator U1A, the operation of the circuit will be provided with a sequential turn-off. This turn-off occurs as follows.

As soon as the transistor pair Q3 and Q102 turn off, the current to the gate of the SCR device SCR101 is almost instantaneously removed. At this point, with no voltage drop across the cathode-anode path of the SCR device and with no gate current being supplied to the gate of the SCR device, the SCR device SCR101 essentially turns off. The contacts of the K2 relay A1 and A2 however, are still closed for about five to 10 milliseconds. The Hexfet transistor pair Q103 and Q104 are still supplied with a gate potential from the capacitor C8 which has charge stored on it. The current requirements for the gates of the Hexfet transistors is almost zero, which is a useful characteristic since it provides the useful benefit that a stored charge on the gate is capable of keeping it operating even though the power sources to the circuit have been lost. The contacts A1 and A2 of the relay K2 begin to open. At this point, there is approximately a 30 millisecond delay before the Hexfets Q103 and Q104 turn off. The two parallel Hexfets effectively shunt the load current around the K2 relay contacts A1 and A2 and around the SCR device SCR101 until the relay contacts K2-A1 and K2-A2 are fully separated. This provides proper operation for the circuit since all of the current at this point is carried by the Hexfets Q103 and Q104. This minimizes any voltage across the open contacts K1-A1 and K1-A2 as they open, preventing any unnecessary arcing. The effective voltage across the relay contacts K1-A1 and K1-A2 as they open under this sequence of operations, is merely a few volts. During this interval, the SCR device SCR101 does not see a large time rate of change of voltage across its cathode-anode path since the Hexfet devices Q103 and Q104 are conducting, and therefore it is not excited into conduction.

Approximately 30 milliseconds later, the comparator U1C and U1D turns off the gate of the two Hexfet transistors Q103 and Q104 by clamping their gate potential to ground potential. This is done through the resistor R26 which helps bleed off the charge on the gates of the Hexfet devices Q103 and Q104. This rate of current bleed-off of the charge on the gates of the Hexfet devices is done at an exponential decay rate which is set to provide a gradual turn-off of the Hexfet devices. This gradual turn-off keeps the SCR device SCR101 from being self-excited through any large voltage changes which may occur during the turn-off operation. As the voltage on the gates of the Hexfet devices Q103 and Q104 reduces, so does the conduction in the Hexfets and as a result, a smooth and orderly turn-off of the current flow through the load device is achieved. Therefore, by operation of the circuit as described above, the two Hexfets eventually turn off after about 30 milliseconds.

Figure 3:
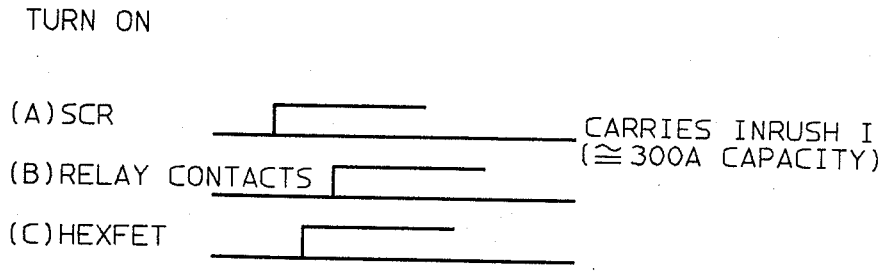
FIG. 3 is a timing diagram illustrating the operation for the "turn-on" of the direct current switching circuit.

Attention can now be turned to FIG. 3 which is a timing diagram illustrating the sequence of operations in turning on the circuit of FIG. 2. The waveform A represents current conduction through the cathode-anode path of the SCR device SCR101. The waveform B represents current conduction through the K2 relay contacts K2-A1 and K2-A2. The waveform C represents current conduction through the pair of Hexfet devices Q103 and Q104. As can be seen from inspection of FIG. 3, when the SCR turns on, most of the load current is handled through it. This includes any in-rush current or spikes due to the capacitive nature of the load. Sometime later, the Hexfet devices turn on. Thereafter, about five to 10 milliseconds later, the relay contacts are closed. As can be seen, the relay K2 has its contacts closed last and therefore the relay contacts switch very small voltage, that voltage being only the forward voltage drop of the conducting SCR. Therefore, no arcing is incurred by the relay K2 upon closure of its contacts.

Figure 4:
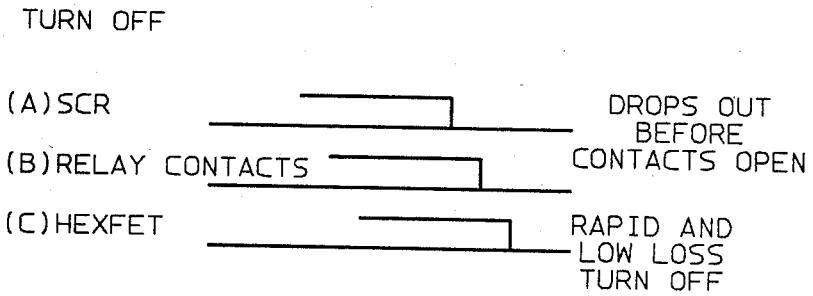
FIG. 4 is another timing diagram illustrating the operation for the "turn-off" of the direct current switching circuit.

In FIG. 4, the waveform diagram illustrates the sequence of operations in turning off the circuit. Waveform A represents current conduction in the SCR device SCR101. Waveform B represents current conduction through the relay K2 contacts Al and A2. Waveform C represents current conduction through the Hexfet devices Q103 and Q104. In the turn-off cycle, the first device to turn off is the SCR. Gate current to the SCR device must be reduced to zero so as to assure that it will stay nonconducting. The SCR device is forced out of conduction by the relay contacts Al and A2 of the relay K2 which are closed, thereby shunting the SCR's cathode-anode path and allowing any load current to bypass the SCR. Since no current passes through the anode-cathode path of the SCR and no gate voltage is applied to the SCR, the SCR will turn off. The sequential turn-off is guaranteed since in order for its contacts to open, the relay K2 must lose the magnetic field produced by the coil current and at the same time it must deprive the SCR of any gate current. The SCR is essentially forced out of operation as soon as the transistor pair Q3 and Q102 turn off. The relay contacts open after their mechanical delay as is shown in FIG. 4, line B, and this is a function of the mechanical design of the relay. The mechanical delay of the relay upon the opening of its contacts, works to advantage in the circuit since it provides for a predictable sequence of operation. In waveform C of FIG. 4, the Hexfets Q103 and Q104 are held in conduction by the charge stored on their gates so that even if one or more of the control voltages are lost, the Hexfet operation is guaranteed for approximately 30 milliseconds. This duration overlaps the period required for the relay K2 contacts A1 and A2 to separate by a sufficient distance to insure that no arcing occurs in the opening of the relay.

As an additional safety measure, the opening of the K1 relay can be delayed for some 500 milliseconds after the Hexfet devices Q103 and Q104 stop conduction, so as to make sure that the relay contacts for the relay K1 do not interrupt any significant load current.

In this manner, an improved direct current switching circuit is obtained which protects switching relays from arcing on both opening and closing, thereby enabling the switching of high voltage, high current power sources.

DETAILED DESCRIPTION OF THE INVENTION

In successfully carrying out the objective of arc suppression for the relay switching the high power to be applied to the load, a predetermined sequence of operations must take place on the relay K2, the SCR101, and the Hexfets Q103 and Q104.

In turning on the arc suppression circuit 10, it is important to turn on the SCR101 prior to the closure of the contacts for the relay K2. As a subsidiary consideration, since there is some resistance in the source/drain path of the Hexfet devices Q103 and Q104, it is important not to apply too much current to those devices during intervals when the contacts of the relay are relatively in close proximity, since voltage spikes can be produced across the contacts as a result, thereby incurring the arcing which is to be avoided. Another reason for delaying the turn-on of the Hexfet devices Q103 and Q104 until after the SCR101 has turned on, is that oftentimes the load has a capacitive characteristic or at least an initially low apparent impedance so that in-rush currents will occur in the beginning of the application of the power to the load. These large magnitude currents, when conducted through the source/drain path of the Hexfet devices Q103 and Q104, will produce voltages on the order of 50 volts or more due to the inherent resistance of the source/drain path. Also, the power which must be dissipated by the Hexfets in conducting the in-rush currents could be destructive of the devices themselves. Therefore it is important to delay the switching on of the Hexfet devices Q103 and Q104 until the SCR101 turns on.

The turn-on operation for the circuit is as follows. Line 22 is the input control line which has two states, +24 volts or zero volts. Zero volts is the off-state for the arc suppression circuit 10 and +24 volts is the on-state. Line 22 passes through the resistor R5 to the base of the NPN bipolar transistor Q4. Transistor Q4 has its collector-emitter path connected between ground potential and the current control circuit 20 comprising the PNP bipolar transistor Q3 and Q102. The current control source circuit 20 turns on when the transistor Q4 goes into conduction. Thus, when a positive going 24 volt enabling signal is applied to line 22 current starts being supplied from the current control current source 20 to the relay coil for the relay K2 and the series-connected gate electrode for the SCR101. There is an insignificant delay in the switching on of the SCR101 at this time. At the instant the positive going signal is applied to the line 22, the SCR101 goes into conduction, thereby initiating the flow of current through the load with which it is series-connected.

The relay K2 is a mechanical device consisting essentially of an inductive coil series-connected between the current source 20 and ground and a spring biased armature which has an inherent inertia. The armature, which is ferromagnetic and in close proximity to the coil of the relay, will be drawn toward the coil of the relay as current flows through the coil. The mechanical motion of the armature draws the electrical contacts A2 and Al of the relay K2 together. The period of time necessary to accomplish a closure of the relay contacts Al and A2 is generally on the order of five to 10 milliseconds from the instant of initial application of the current to the coil. Thus, by the time the contacts A1 and A2 are electrically connected, the voltage between the anode and cathode of the SCR101 is approximately on the order of one to two volts. Since the SCR101 is connected in parallel with the contacts A1 and A2 of the relay K2, the potential difference between the contacts during the closure operation is well below those magnitudes which would result in destructive arcing. Thus, reliance is placed upon the inherent delay in the operation of closure for the armature in the relay K2 and the almost instantaneous turn-on operation of the SCR101, to avoid producing destructive arcs across the contacts of the relay K2 as it closes.

As was mentioned before, it is desirable to delay the onset of conduction of the Hexfets Q103 and Q104 until the SCR101 is fully conducting the load current. This is accomplished as follows. As the potential of the control signal on line 22 goes positive, that control signal is applied through the diode CR5 to the RC circuit consisting of the resistor R30 and the capacitor C7, charging up the capacitor C7 so that node 26 rises in potential above its original ground potential value. Node 26 is connected to two comparators, U1C and U1D. Node 26 is connected to the negative input terminal of the comparator U1C and it is connected to the positive input terminal of the comparator U1D. Line 24 in FIG. 2 supplies a DC potential of 24 volts which is dropped through a resistor divider network consisting of the resistor R10 and R31 so that an approximate 12 volt potential is applied to the positive terminal of the comparator UlC and to the negative terminal of comparator U1D. The comparator U1C carries out the function of outputting a ground potential when the negative input terminal is more positively biased than the positive input terminal and alternately U1C will output a positive potential of approximately 24 volts when the negative terminal has a lower potential than the positive input terminal. The operation of the comparator U1D is identical to that described for U1C, however because the inputs for the two devices are oppositely connected, when line 26 has a potential greater than 12 volts, U1C will output a ground potential and U1D will output a positive 24 volt potential. Alternately, the opposite effect will take when line 26 is less than 12 volts.

The relative magnitude of the resistor R30 and the capacitor C7 are such that line 26 will rise to a potential of approximately 12 volts approximately five milliseconds after line 22 starts rising in its potential. As line 26 rises in potential to above 12 volts, the output of the comparator U1C goes to ground potential. The output of comparator U1C is connected to base of the PNP bipolar transistor Q2 and this operation turns on the transistor Q2, thereby supplying the 24 volts on line 24 to the gates of the Hexfet devices Q103 and Q104. The potential on the gates of the Hexfet devices rises, thereby turning on the Hexfet devices Q103 and Q104 approximately five milliseconds after the SCR101 has turned on. Provision is made for not applying excessive magnitudes of gate voltage to the Hexfet devices Q103 and Q104 by including a zener diode CR101 which is connected between the gates and ground potential. The zener diode can be selected to clamp the gate potential at approximately 10 volts, for example, thereby insuring proper operation for the Hexfet devices.

In this manner, a control sequence is achieved for initially turning on the SCR101 to conduct the load current, followed after five milliseconds by the turning on of the Hexfet devices Q103 and Q104 and followed by 10 milliseconds from the initial turn-on of the SCR101, to complete the closure of the contacts Al and A2 of the relay K2. In this manner, a controlled turn-on of the arc suppression circuit 10 is achieved.

When the load current is to be interrupted, it is important not to open the contacts A1 and A2 of the relay K2 since these contacts are conducting as much as 20 amperes of direct current at the voltage of approximately 150 volts. Opening up the contacts under this circumstance would draw a tremendous arc destroying the relay. Thus the sequence of events for turning off the elements must be structured to assure that when the contacts A1 and A2 of the relay K2 are separated, the voltage between the contacts is small enough not to draw an arc.

Recall that during full current conduction by the arc suppression circuit 10, the relay contacts A1 and A2 of the relay K2 are closed, the SCR101 is conducting in its anode-cathode path, and the Hexfets Q103 and Q104 are conducting in their source/drain paths. When the potential of the control signal on line 22 drops from its enabling level of 24 volts to its turn-off level of zero volts, the NPN bipolar transistor Q4 stops conducting and therefore the potential at the gate of the PNP bipolar transistor Q102 goes high turning off the current source circuit 20. This interrupts the gate current to the SCR101. Since the relay contacts A1 and A2 are connected in parallel across the cathode-anode path of the SCR101, there is now zero volts potential across the cathode-anode path and there is also zero gate current to the SCR101. Thus the SCR101 is turned off, no longer conducting any of the load current. The load current at this instant is now being conducted by the Hexfet devices Q103 and Q104 and by the contacts A1 and A2 of the relay K2.

The Hexfet devices Q103 and Q104 remain on because the potential of their respective gates is maintained at approximately 10 volts by virtue of the charge stored on capacitor C8. The charge stored on the capacitor C8 cannot pass through the reverse-biased diode CR7 but must, instead, pass through the resistor R26 to the output node of the comparator U1D and through the relatively large value resistor R21 to the line 26. Line 26 will only slowly decay in its potential, its voltage being sustained by the RC circuit R30 and C7. The relative values of the components R30 and C7 have been selected so that it takes approximately 30 milliseconds for the magnitude of the voltage on line 26 to decay below 12 volts. It will be recalled that when the potential of line 26 decays below 12 volts, the comparator U1D switches its output so that it becomes conductive to ground potential. When the output node of the comparator U1D becomes conductive to ground potential, it will enable the conduction of the charge stored on the capacitor C8 to flow through the resistor R26, thereby reducing the potential applied to the gates of the Hexfet devices Q103 and Q104. This will occur some 30 milliseconds after line 22 had the control signal reduced to ground potential.

In the meantime, the armature of the relay K2 begins to move, separating the contacts A1 and A2. The inertia of the armature for the relay K2 is such that it will require approximately 10 milliseconds to separate the contacts A1 and A2 by a sufficient distance to avoid arcing events. Since the Hexfet devices Q103 and Q104 are still in their conduction states during the opening of the contacts A1 and A2 of the relay K2, since the Hexfet devices have their source/drain paths connected in parallel across the contacts A1 and A2, the potential difference between the contacts A1 and A2 remains at approximately four or five volts during the opening of the relay K2. This magnitude potential is not sufficient to incur destructive arcing and thus the relay K2 is protected during the opening of its contacts.

As was discussed above, approximately 30 milliseconds after the turning off of the control signal on line 22, the potential of line 26 drops below 12 volts, thereby rendering the comparator U1D to have its output node conductive to ground potential. This enables a controlled bleed-off of the charge stored on the capacitor C8 through the resistor R26, thereby tailoring the contour of the decay of the potential on the gates of the Hexfet devices Q103 and Q104 so that the Hexfet devices are switched off during a short interval. That short interval is designed to be long enough so that a large value for the time rate of change of voltage will not be felt by the SCR101, thereby inhibiting re-ignition of the SCR device.

Thus it is seen that the turning off of the arc suppression circuit 10 is achieved by sequentially turning off first the SCR101, followed by opening the contacts A1 and A2 of the relay K2, and then and only thereafter when the contacts Al and A2 are safely separated, is the Hexfet devices Q103 and Q104 turned off in a controlled manner.

One of the many advantages of the arc suppression circuit 10 is that by judicious sequencing of the various components therein, a small relay K2 can be used to switch very large quantities of direct current power, which would otherwise require large, open frame relays which are heavy and expensive.

In addition, since there are no exposed arcs with the arc suppression circuit 10, the circuit can be safely employed in hazardous environments such as flammable gases or powders.

Although a specific embodiment of the invention has been disclosed, it will be understood by those of skill in the art that the foregoing and other changes in form and details may be made therein without departing from the spirit and the scope of the invention.

I claim:

1. A DC power switching circuit, connecting a load to a DC power source, comprising:

a normally open relay, having an energizing coil with a first end connected to a control input terminal and a second end, and having a pair of switching contacts, the first contact of said pair being connected to said load and the second contact of said pair being connected to said DC power source, said contacts closing from an open state after a first delay interval in response to an on-signal at said control input terminal;

an SCR having its principal current conducting path connected between said load and said DC power source and having its control gate connected to said second end of said relay energizing coil, conducting current between said load and said power source during said first delay interval, thereby reducing the potential difference between said first and second contacts of said relay, preventing arcing between said relay contacts during the closure thereof;

an FET having its principal current conducting path connected between said load and said DC power source and having a control gate;

a timer having a control input connected to said control input terminal and an output connected to said gate of said FET, maintaining on said FET gate for a duration of a second delay interval in response to an off-signal at said control input terminal, said relay contacts opening from a closed state in response to said off-signal after a delay which is shorter in duration than said second delay interval;

said SCR gate turning off substantially when said off-signal occurs and said timer turning on said FET substantially when said off-signal occurs, said FET device in response thereto conducting current between said load and said power source during said second delay interval, thereby reducing the potential difference between said first and second contacts of said relay, for preventing arcing between said relay contacts during the opening thereof.

2. A DC power switching circuit, connecting a load to a DC power source, comprising:

a low voltage control section having a signal input for receiving an on/off signal;

a first voltage level detector in said low voltage section, preventing the operation of said circuit if said on/off signal has an insufficient voltage magnitude;

a high voltage switching section having a control input terminal connected to an output of said low voltage control section, switching high voltage DC power from said power source to said load in response to said on/off signal;

a second voltage level detector in said high voltage section, preventing the operation of said circuit if said DC power source has an insufficient voltage magnitude;

a normally open relay in said high voltage section, having an energizing coil with a first end connected to said control input terminal and a second end, and having a pair of switching contacts, the first contact of said pair being connected to said load and the second contact of said pair being connected to said DC power source, said contacts closing from an open state after a first delay interval in response to an on-signal at said control input terminal;

an SCR in said high voltage section having its principal current conducting path connected between said load and said DC power source and having its control gate connected to said second end of said relay energizing coil, conducting current between said load and said power source during said first delay interval, thereby reducing the potential difference between said first and second contacts of said relay, preventing arcing between said relay contacts during the closure thereof;

an FET in said high voltage section having its principal current conducting path connected between said load and said DC power source and having a control gate;

a timer in said high voltage section having a control input connected to said control input terminal and an output connected to said gate of said FET, turning on said FET gate for a duration of a second delay interval in response to an off-signal at said control input terminal, said relay contacts opening from a closed state in response to said off-signal after a delay which is shorter in duration than said second delay interval;

said SCR gate turning off substantially when said off-signal occurs and said timer turning on said FET substantially when said off-signal occurs, said FET device in response thereto conducting current between said load and said power source during said second delay interval, thereby reducing the potential difference between said first and second contacts of said relay, preventing arcing between said relay contacts during the opening thereof.

* * * * *